United States Patent [19]

Bronson et al.

[11] Patent Number: 4,566,382

[45] Date of Patent: Jan. 28, 1986

[54] LINE CODER SYSTEM FOR USE ON EITHER SIDE OF CONVEYOR LINE

[75] Inventors: James C. Bronson, Lakeland; Donald C. Wright, Jr., St. Petersburg, both of Fla.

[73] Assignee: Lakeland Rubber Stamp Company, Inc., Lakeland, Fla.

[21] Appl. No.: 701,251

[22] Filed: Feb. 13, 1985

[51] Int. Cl.[4] ..... B41F 17/26

[52] U.S. Cl. ..... 101/35; 101/331

[58] Field of Search ..... 101/35, 328–331, 101/36, 37

[56] References Cited

U.S. PATENT DOCUMENTS

| | | | |
|---|---|---|---|
| 2,834,285 | 5/1958 | Gottscho et al. | 101/35 |
| 2,923,232 | 2/1960 | Worth | 101/35 |
| 3,624,730 | 11/1971 | Gottscho | 101/35 |

*Primary Examiner*—Clifford D. Crowder

*Attorney, Agent, or Firm*—Dowell & Dowell

[57] ABSTRACT

A line coder system includes an upright post mounted on a conveyor line and having an outstanding arm on which a rotatably mounted printing roller is mounted in association with a rotatable ink reservoir, the inward end of the arm being rotatably mounted on a shaft. A cross head mounted on the upper end of the shaft has a pin which engages the outer end of a spring assembly which tends to return the arm to a preselected position after it is moved by the containers which engage the printing roller.

5 Claims, 4 Drawing Figures

LINE CODER SYSTEM FOR USE ON EITHER SIDE OF CONVEYOR LINE

BACKGROUND OF THE INVENTION

1. Field of the Invention

This invention relates to inking systems and particularly those used with conveyors in which articles moving along the conveyor are engaged by an inking member mounted adjacent to the conveyor, in which the inking member is moved outwardly of the conveyor as a result of its engagement with successive containers.

2. Description of the Prior Art

Devices for mounting inking members adjacent to a conveyor so that the inking members may be engaged by the containers on the conveyor and moved aside, and then return into the path of the containers have been known heretofore. For example, in Pat. No. 2,775,192, to Hirschey, an inking system is disclosed in which the arm is returned by means of the springs that are described in the patent.

Other patents disclosing arms carrying inking devices for engagement with articles which may be on a conveyor are disclosed for example in U.S. Pat. Nos. 2,901,972 to Gottscho et al.; Farrell 2,905,087; Casey 3,021,783; and Marozzi 3,457,854.

SUMMARY OF THE INVENTION

The invention includes an inking system including an upright shaft carrying an arm with an end portion mounted to rotate on a shaft, the arm carrying beneath its outer end a printing roller in association with an inking roller such that rotation of the printing roller in association with an inking roller maintains a required supply of ink to the printing roller. The upper end of the post has a cross head mounted on it with a pin on its outer end which engages a cross block at the outer end of a spring assembly, the inner end of the spring assembly also having a cross block which is rotatably mounted on the arm. Within the inner cross block a pair of parallel shafts are mounted on which compression spring members are positioned, the other ends of the shafts extending through the outer cross block. Fastening means are provided on the outer ends of the shafts in order to adjust the distance between the cross blocks and, therefore, set an initial compression on the springs. The assembly may be positioned on either side of a conveyor so that when a container on the conveyor engages the printing roller it causes the arm to rotate on the shaft and thereby compress the springs and thus hold the printing roller against the container. When a container no longer engages the roller, the springs cause the arm to return to its original position.

DESCRIPTION OF THE PREFERRED EMBODIMENT

Figure 1:
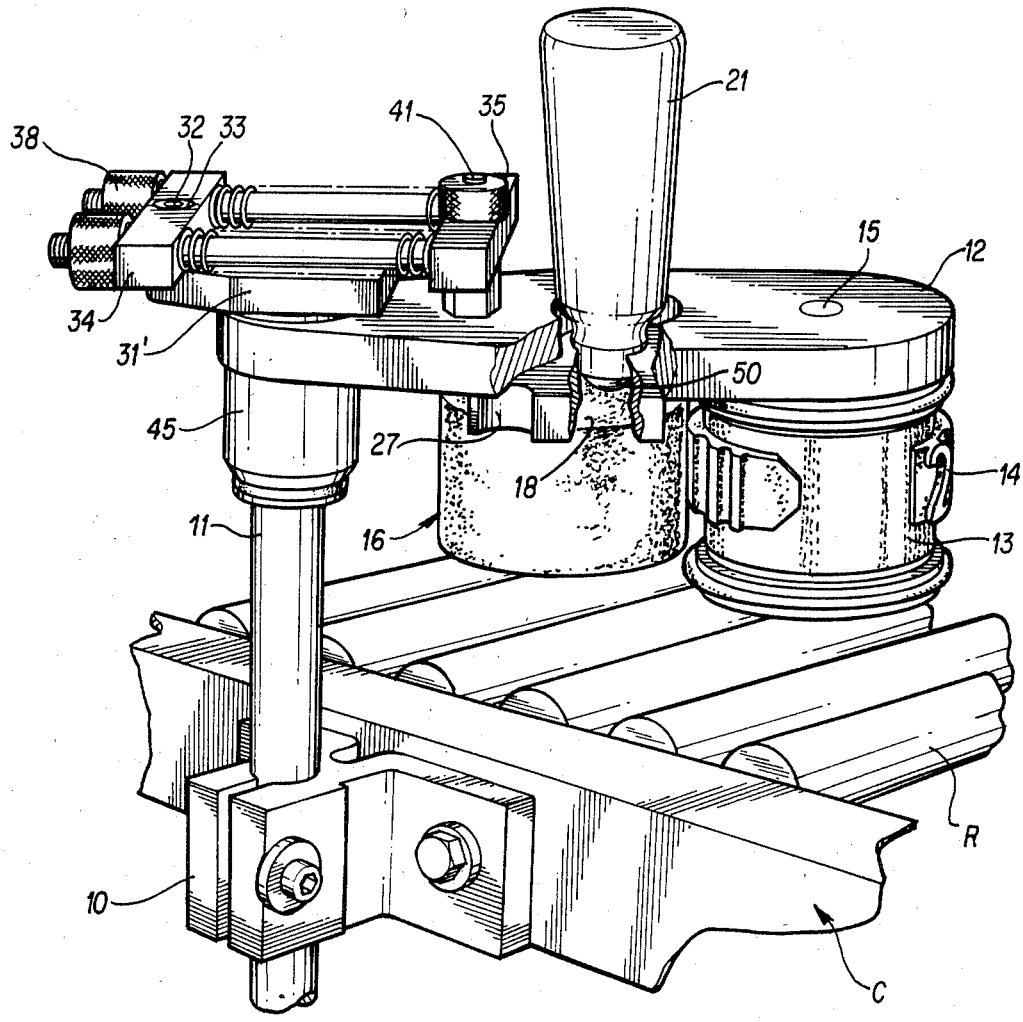
FIG. 1 is a perspective of an inking system in accordance with the present invention.
Figure 4:
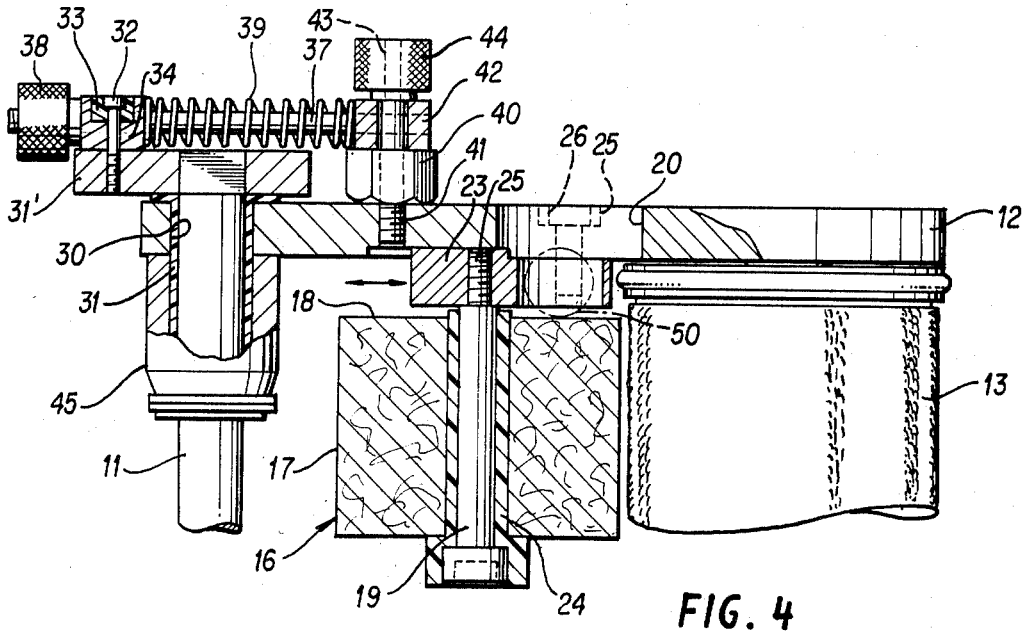
FIG. 4 is a section on the line 4—4 of FIG. 2.

With further reference to the drawings, a conveyor C having rollers R for the passage of articles such as containers or boxes B to be marked is illustrated. Mounted on the side frame of the conveyor is a bracket 10 which supports an upright post 11 on which is mounted an arm 12. The arm 12 carries a rotatable drum or printing roller 13 having on its outer surface a printing die 14, the drum being rotatably mounted on a shaft 15.

In order to provide a continuous coating of ink on the printing die an inking roller reservoir or cartridge 16 having a cylindrical surface 17 and an upper substantially horizontal surface 18 is rotatably mounted by a shaft 19 carried on the arm 12, both the printing roller and the inking roller being mounted beneath the arm 12.

The arm 12 has an opening 20 through which the lower end portion of a container for ink 21 extends. The discharge outlet of the container is snugly received within an opening 22 carried in a plate member 23 that is mounted immediately beneath the arm 12. The container has a ball 50 in engagement with the cartridge surface 18 so that upon rotation of the cartridge it will deliver a supply of ink. The arm has a pair of elongated bores 25, one at each side of the opening 20 through which fastening means 26 extend into the plate member 23, thereby permitting adjustment of the plate member to receive the discharge outlet of the bottle, and at the same time to permit positioning of the inking roller in engagement with the printing die and roller. The shaft 19 extends through sleeve 24 into threaded engagement at its end 25 with member 23.

In order to facilitate adjustment of the plate 23 the sides thereof have indentations 27 which may be engaged by the fingers of the operator.

Figure 2:
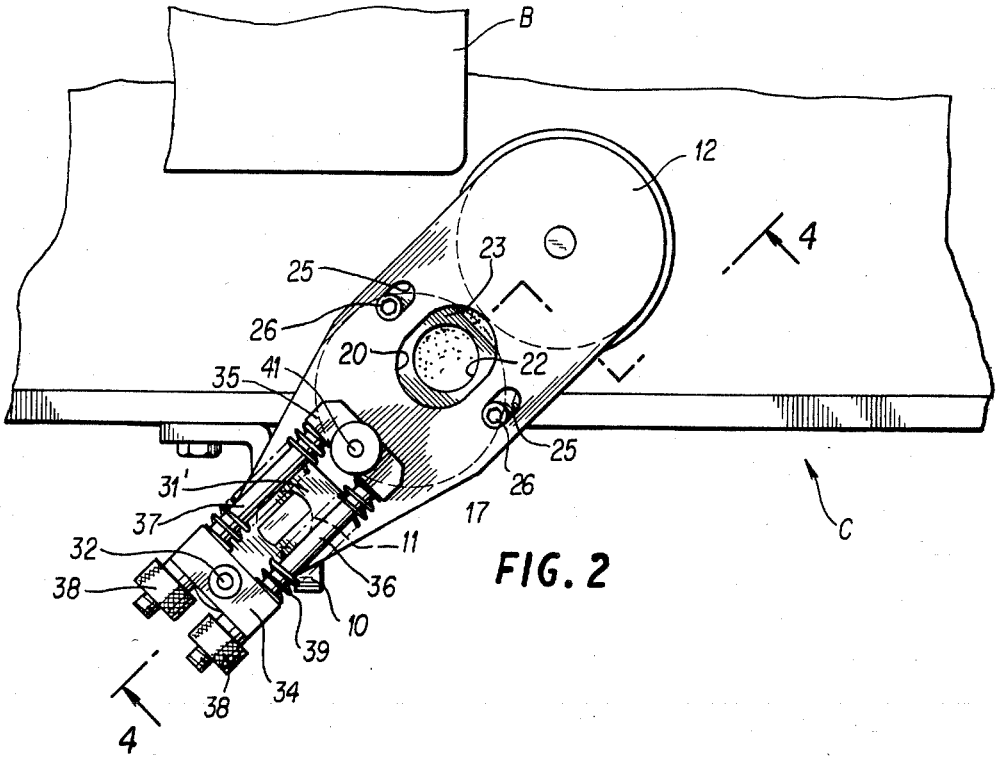
FIG. 2 is a top plan view illustrating the arm in position prior to engagement with a container.
Figure 3:
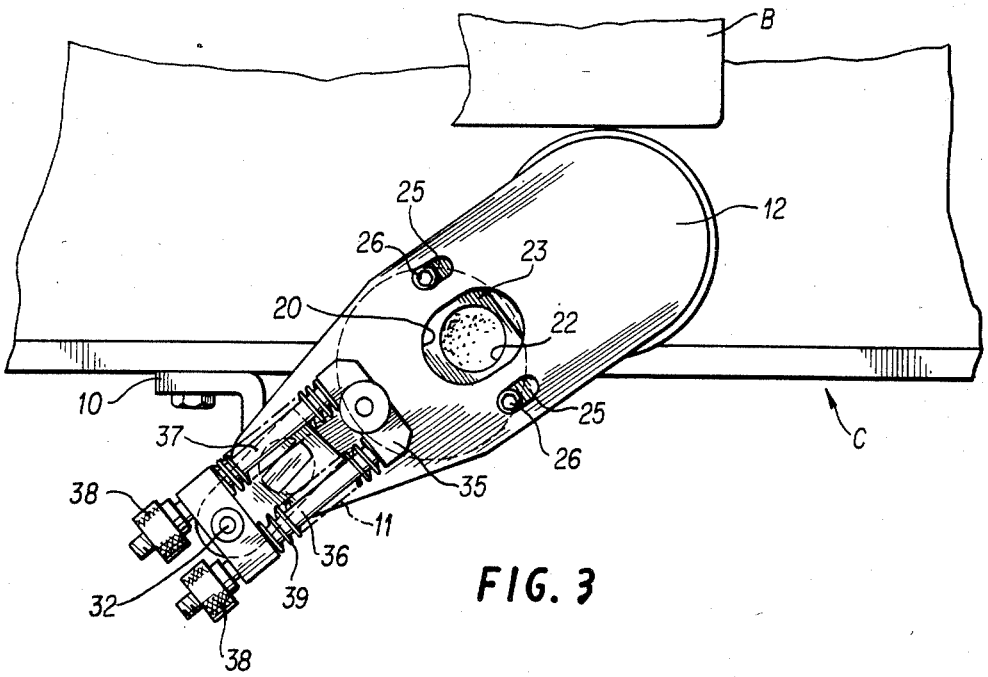
FIG. 3 is a view like FIG. 2 illustrating the arm in inking position.

Adjacent to the end of the arm 12 there is an opening 30 which receives the upper end of the shaft 11 in bushing 31 so that the arm 12 may rotate about the shaft. The upper end of the shaft extends just above the arm and is rigidly connected to a cross head 31' which extends generally longitudinally of the arm 12 when it is in a position of rest as indicated in FIG. 2. The outer end of the cross head has a pin 32 which extends upwardly through bushing 33 in an outer cross block 34 of a spring assembly. The spring assembly includes an inner cross block 35 which is spaced from the cross block 34. Mounted within the cross block 35 are a pair of shafts 36 and 37 which extend from the cross block 35 through the cross block 34 and have threaded fastening means 38 at their outer ends for positioning the cross block 34 along the shafts 36 and 37.

Mounted on each of the shafts 36 and 37 is a compression spring 39, the initial compression of which may be adjusted by adjusting the relative position of the outer cross block with respect to the inner cross block.

The inner cross block 35 is mounted above a spacer 40 by pin 41 which extends through bushing 42 in the cross block 35. The pin extends downwardly through the spacer in which it is fixed and has a lower threaded end portion received in the arm 12. The upper end portion 43 is threaded to receive a knurled nut 44.

In order to mount the arm 12 in the desired position on the shaft 11 a collar 45 is fixed to the shaft at the appropriate position.

In the operation of the device the arm 12 is first mounted by means of shaft 11 in the bracket 10 with the arm extending at the appropriate elevation above the conveyor and at an appropriate angle for engagement by articles passing along the conveyor, with the cross head 31' being substantially parallel with the arm. As articles pass along the conveyor they engage the printing roller 13 and thereby exert a force on the arm 12 which causes it to rotate about the axis of the shaft 11. This rotation in turn causes the cross block 34 to rotate around the pin 32, thus shortening the distance between the inner and outer cross blocks and thereby compressing both springs 39. The compression of the springs tends to maintain the printing roller in engagement with the article on the conveyor which is engaged and when the article has passed the springs cause the arm to move back to its previous position.

Because of the arrangement of the elements of the structure it is apparent that the system may be mounted on either side of the conveyor so that it may operate from either side with equal facility. Furthermore, because of the mounting of the printing roller beneath the arm the printing roller may be closely proximate to the conveyor itself and thereby can engage a container moving along a conveyor at a distance just above the conveyor, if desired.

We claim:

1. A marking device for use with a conveyor carrying successive containers past the device to apply markings to one or more surfaces of each of the successive containers, said marking device comprising post means mounted adjacent to one side of the conveyor, an arm having an end portion rotatably mounted on the post means above the level of the conveyor, said arm carrying a printing roller having printing means and rotatably mounted below its outer end and an inking roller rotatably mounted inwardly of the printing roller and in engagement with the printing means on the printing roller during rotation of the printing roller, ink supply means mounted on the arm and in engagement with the inking roller, a cross head fixed to the upper end of said post means above said arm, said cross head having a portion spaced from the axis of said post means, pin means mounted in said spaced portion, a spring assembly, said spring assembly comprising a first cross block extending transversely of said arm and having its central portion pivotally carried by said support arm, rod means extending from each side of said first cross block and substantially parallel with said support arm, a second cross block extending transversely of said arm and having its central portion rotatably engaged with said pin means and having spaced openings which receive said rod means, said rod means extending beyond said second cross head, the ends of said rod means having adjustably mounted retaining means for shifting the position of the second cross block along said rod means, and compression spring means mounted on each of said rod means and tending to urge said first and second cross blocks apart, whereby engagement of a container with said printing roller causes said arm to pivot out of the path of said container whereby said second cross block is moved closer to said first cross block thereby compressing said springs and whereby when said container has passed, said springs cause said support arm to return to the initial position.

2. The invention of claim 1, in which said support arm has an opening therethrough for receiving the mounth of an ink supply container, and in which plate means is mounted beneath said opening and said support arm and has an opening therethrough for snugly receiving the lower end portion of said container, said support plate being mounted for shiftable movement along said support arm whereby the spacing between said printing roller and said inking roller may be adjusted.

3. The invention of claim 1 in which said post means, said printing roller and said inking roller are substantially aligned along said arm, whereby said marking device may be mounted for use on either side of a conveyor line.

4. The invention of claim 2 in which said plate has indentations along its sides by which it may be engaged to facilitate its adjustment.

5. A marking device for use with a conveyor carrying successive containers past the device to apply markings to one or more surfaces of each of the successive containers, said marking device comprising post means mounted adjacent to one side of the conveyor, an arm having an end portion rotatably mounted on the post means above the level of the conveyor, said arm carrying a printing roller having a printing means and rotatably mounted below its outer end and an inking roller rotatably mounted inwardly of the printing roller and in engagement with the printing means on the printing roller during rotation of the printing roller, pin means, means fixed to the upper end of said post means above said arm and carrying said pin means spaced from the axis of said post means, a spring assembly, said spring assembly comprising a first cross block extending transversely of said arm and outwardly of said post means and adjacent to said rollers and pivotally carried by said arm, rod means extending from said first cross block generally inwardly of said post means and substantially parallel with said arm, a second cross block extending transversely of said arm and rotatably engaged with said pin means and slideably engaging said rod means, and compression spring means mounted on said rod means and tending to urge said first and second cross blocks apart, whereby engagement of a container with said printing roller causes said arm to pivot out of the path of said container and said second cross block is moved closer to said first cross block thereby compressing said spring means and when said container has passed, said spring means causes said support arm to return to the initial position.

* * * * *